US005826994A

United States Patent [19]

Palmer

[11] Patent Number: 5,826,994

[45] Date of Patent: Oct. 27, 1998

[54] TAPE PRINTING APPARATUS

[75] Inventor: Mathew Richard Palmer, Cottenham, United Kingdom

[73] Assignee: Esselte NV, Sint-Niklaas, Belgium

[21] Appl. No.: 698,625

[22] Filed: Aug. 16, 1996

[30] Foreign Application Priority Data

| | | | |
|---|---|---|---|
| Aug. 25, 1995 | [GB] | United Kingdom | 9517487 |
| Nov. 1, 1995 | [GB] | United Kingdom | 9522339 |

[51] Int. Cl.[6] ..... B41J 2/355; B41J 2/36

[52] U.S. Cl. ..... 400/615.2; 400/120.05; 400/120.09; 347/180; 347/211

[58] Field of Search ..... 400/120.08, 120.02, 400/615.2, 120.05, 120.06, 120.01, 120.1, 120.18, 120.09; 347/181, 182, 188, 192, 211, 180

[56] References Cited

U.S. PATENT DOCUMENTS

| | | | |
|---|---|---|---|
| 4,528,572 | 7/1985 | Sasaki et al. | 346/76 PH |
| 4,542,997 | 9/1985 | Matsushima | 400/120 |
| 4,575,732 | 3/1986 | Kitaoka | 346/76 PH |
| 4,745,413 | 5/1988 | Brownstein et al. | 346/76 PH |
| 5,682,504 | 10/1997 | Kimura et al. | 395/104 |

FOREIGN PATENT DOCUMENTS

| | | | |
|---|---|---|---|
| 0 113 250 A2 | 7/1984 | European Pat. Off. . | |
| 0 138 493 A2 | 4/1985 | European Pat. Off. . | |
| 249523 | 12/1987 | European Pat. Off. . | |
| 0 478 369 A2 | 4/1992 | European Pat. Off. . | |
| 0 535 294 A1 | 4/1993 | European Pat. Off. . | |
| 0 635 374 | 2/1996 | European Pat. Off. . | |
| 4438600 | 5/1995 | Germany . | |
| 63-82763 | 4/1988 | Japan | 400/120 |
| 1 217 690 | 12/1970 | United Kingdom . | |
| 2 087 116 | 5/1992 | United Kingdom . | |

OTHER PUBLICATIONS

Patent Abstracts of Japan vol. 6, No. 134 (M–144) [1012], 21. Jul. 1982 (JPA–57 057680).

*Primary Examiner*—John S. Hilten
*Attorney, Agent, or Firm*—Pennie & Edmonds LLP

[57] ABSTRACT

A tape printing device comprises a print head, means for causing relative movement between an image receiving tape and the print head, and control circuitry for controlling the print head. The print head has a set of selectively activable printing elements arranged along a longitudinal axis of the print head. The control circuitry prints each pixel by activating the same printing elements on successive print cycles to limit the peak current of the print head. Each group of printing elements lie at an acute angle with respect to a longitudinal axis of the print head to prevent staggering in the printed image. The tape printing device uses an arrangement of group switches and switches for individual printing elements to reduce the required number of switches which reduces the cost of the apparatus. Current is controlled to prevent accidental activation of printing elements to reduce the number of errors in the printed image.

20 Claims, 7 Drawing Sheets

TAPE PRINTING APPARATUS

TECHNICAL FIELD

The present invention relates to a print head for a tape printing apparatus, as well as to a controller for the print head of the apparatus.

BACKGROUND OF THE INVENTION

Known tape printing devices of the type with which the present invention is concerned are disclosed in U.S. Pat. Nos. 4,927,278 and 4,966,476. These printers include a printing device having a cassette receiving bay for receiving a cassette or tape holding case. In these patents and in U.S. Pat. No. 4,815,871, the tape holding case houses an ink ribbon, a transparent image receiving tape, and a double-sided adhesive tape. The double-sided adhesive tape is secured at one of its adhesive coated sides to the image tape after printing and has a backing layer which is removable from its other adhesive coated side. In these devices, the image transfer medium (usually an ink ribbon) and an image receiving tape (or substrate) are in the same cassette.

Another type of tape printing apparatus is generally described, for example, in U.S. Pat. No. 5,458,423. In this printing apparatus, the substrate tape is similar to that described in U.S. Pat. No. 4,815,871, but is housed in its own tape holding case while the ink ribbon is similarly housed in its own tape holding case.

In these cases, the image receiving tape passes in overlap with the ink ribbon to a print zone consisting of a fixed print head and a platen against which the print head can be pressed to cause an image to transfer from the ink ribbon to the image receiving tape. There are many ways of doing this transfer including dry lettering or dry film impression. The most typical way uses thermal printing where the print head is heated and the heat causes ink from the ink ribbon to be transferred to the image receiving tape.

The print head for such printing devices generally comprise a plurality of printing elements which are selectively activable. In other words, the printing elements can be selectively heated. When the activated printing elements of the print head become heated, the ink from the parts of the ink ribbon that come in contact with the heated printing elements is transferred to the image receiving tape. Alternatively, the heated printing elements may directly contact a thermally sensitive image receiving tape which causes an image to be formed thereon. These known print heads generally comprise a column of printing elements which have a height which corresponds to the width of the image receiving tape. All of the printing elements can be activated simultaneously.

In use, the tape is moved past the print head and the print head is activated in cycles to provide the desired image on the image receiving tape. A typical cycle will last for 10 milliseconds. The printing elements, which are to be activated in the cycle are activated (i.e. heated) for 2 milliseconds of the cycle. Thus, for 8 milliseconds of the cycle, none of the printing elements of the print head will be activated. This part of the cycle allows the power supply to recover and allows the print head to cool. The apparatus is arranged to provide a relatively large maximum peak current to enable the activation of all the printing elements in the 2 millisecond part of the cycle. However, high peak currents are disadvantageous because they reduce the battery life which causes a problem for hand held tape printing devices which are typically powered by batteries.

To reduce the peak current, the printing elements can be arranged into different groups where each group is activated at a different time in the printing cycle. To compensate for the resulting staggered effect on the print line, these groups of printing elements could be properly arranged in staggered columns. However, this scheme leads to further problems for print heads which have their printing elements arranged on a semi-circular "glaze" bump. A print head is composed of a ceramic substrate on which resistive elements are deposited. These resistive elements are the printing elements of the print head. In order to improve the contact between the image receiving medium and the printing elements, the resistive elements are deposited on top of a protective glaze. This glaze has a generally semi-circular profile and extends generally in the direction of the longitudinal axis of the print head to define a "glaze bump". If staggered columns of printing elements are utilized to address the problem with the peak current as mentioned previously, the center of each column of printing elements may be at different locations relative to the longitudinal axis of the glaze bump. This problem may affect the quality of print.

In addition to problems with a high peak current and with the quality of the print, known tape printing devices have an additional disadvantage of requiring a large number of switches. For example, DE-A-4438600 discloses a thermal printing device which has approximately 2560 printing elements which are arranged in four groups. In known arrangements such as the DE-A-4438600, a switch is typically provided for each printing element of the print head. This arrangement leads to a large number of switches which increases the cost of the device.

Finally, known tape printing apparatus encounter problems with activation of printing elements which should not be activated. Current flowing near printing elements causes the accidental, parasitic activation of these printing elements, which leads to errors on the image receiving tape.

Thus, there remains a need for improvements in these type devices. The present invention provides one device which provides improvements in these areas.

SUMMARY OF THE INVENTION

In general, it is an object of the invention to provide a tape printing apparatus which has the advantages of extending battery life, improving the quality of the print, reducing cost, and preventing errors in the print.

It is a further object of the invention to provide a tape printing apparatus which limits the peak current of the apparatus.

It is a further object of the invention to provide a tape printing apparatus which limits the stagger on the print medium which typically results from activating different groups of printing elements at different times in the printing cycle for printing on a continuously moving tape.

It is a further object of the invention to provide a tape printing apparatus which improves the quality of the printed image by compensating for the problems associated with using printing elements arranged on a glaze bump.

It is a further object of the invention to provide a tape printing apparatus with a reduced number of switches to lower the cost of the apparatus.

It is a further object of the invention to provide a tape printing apparatus which reduces the number of errors in the printed image by preventing accidental activation of print elements.

In accordance with the above objects and others that will be mentioned and will become apparent hereinbelow, the present invention comprises a tape printing apparatus which includes a print head having a set of selectively activable printing elements arranged generally along a longitudinal axis of the print head, means for causing relative movement between an image receiving tape and the print head to print an image on the tape in the form of a plurality of contiguous columns of pixels, and control circuitry for controlling the print head by generating a plurality of printing cycles wherein in each printing cycle selected printing elements are activated to print a line on the image receiving tape, wherein each pixel in a printed column is printed by generating a number of successive printing cycles to activate the same printing elements a corresponding number of times at contiguous locations on the image receiving tape.

In this device, it is preferred that the means for causing relative movement between the image receiving tape and the print head performs a continuous relative movement while the printing elements are activated. Advantageously, each of the pixels is printed by generating two or more successive printing cycles, wherein in each of the successive printing cycles the same ones of the printing elements are activated twice at contiguous locations on the image receiving tape. Thus, activation of the same ones of the printing elements at contiguous locations on the image receiving tape by the successive printing cycles generates generally square pixels.

Alternatively, each of the printing elements can have a rectangular shape so that each of the pixels of the plurality of contiguous columns of pixels has a square shape. In this embodiment, the square shape of each pixel may be formed from between 2 and 8 activations of the rectangular shaped printing elements.

Preferably, the printing elements are arranged in at least two groups which are individually selectively activable at different times in each of the plurality of printing cycles. The groups of printing elements may be arranged to be staggered with respect to each other, whereby when the print head is arranged to print an image on the image receiving tape, the staggering of the at least two groups compensates for the activation period for each of the groups occurring at different times in the printing cycle. Each of the groups can be horizontally staggered generally along a longitudinal axis of the print head, or positioned at an acute angle with respect to the longitudinal axis of the print head.

The activation periods of the groups can occur at different times in each of the plurality of printing cycles and can be evenly distributed throughout each of the plurality of printing cycles. Preferably, the print head is a thermal print head, and, in certain embodiments, each printing element has a square shape.

Another embodiment of the invention relates to a tape printing device having a print head comprising at least two groups of printing elements, with printing elements being selectively activable to provide an image on a printing medium. The groups of printing elements are activable at different times during a printing cycle, and the device includes control means comprising a common set of switches arranged to control the selective activation of the printing elements in each of the groups. Also provided is group select means for selecting between the groups so that only one is activated at a given time. Each set of switches is arranged to control one of the printing elements in each of the groups, wherein a resistive path is provided for each of the groups, each path being arranged in parallel with the printing elements of the groups to steer current away from the printing elements which are not to be activated to prevent accidental activation of the same.

In this embodiment, activation of the groups of printing elements is conducted to generate generally square pixels. As noted above, one way to do this is to provide printing elements having a rectangular shape. Preferably, the square shape of each pixel can be formed by the activation of between 2 and 8 groups of rectangular shaped printing elements. The groups of printing elements can be arranged to be staggered with respect to each other, either horizontally or at an acute angle with respect to the longitudinal axis of the print head. As above, the print head can be a thermal print head.

BRIEF DESCRIPTION OF THE DRAWINGS

A more complete understanding of the invention may be obtained by reading the following description in conjunction with the appended drawings in which like elements are labeled similarly and in which.

DETAILED DESCRIPTION OF THE PREFERRED EMBODIMENTS

Figure 1:
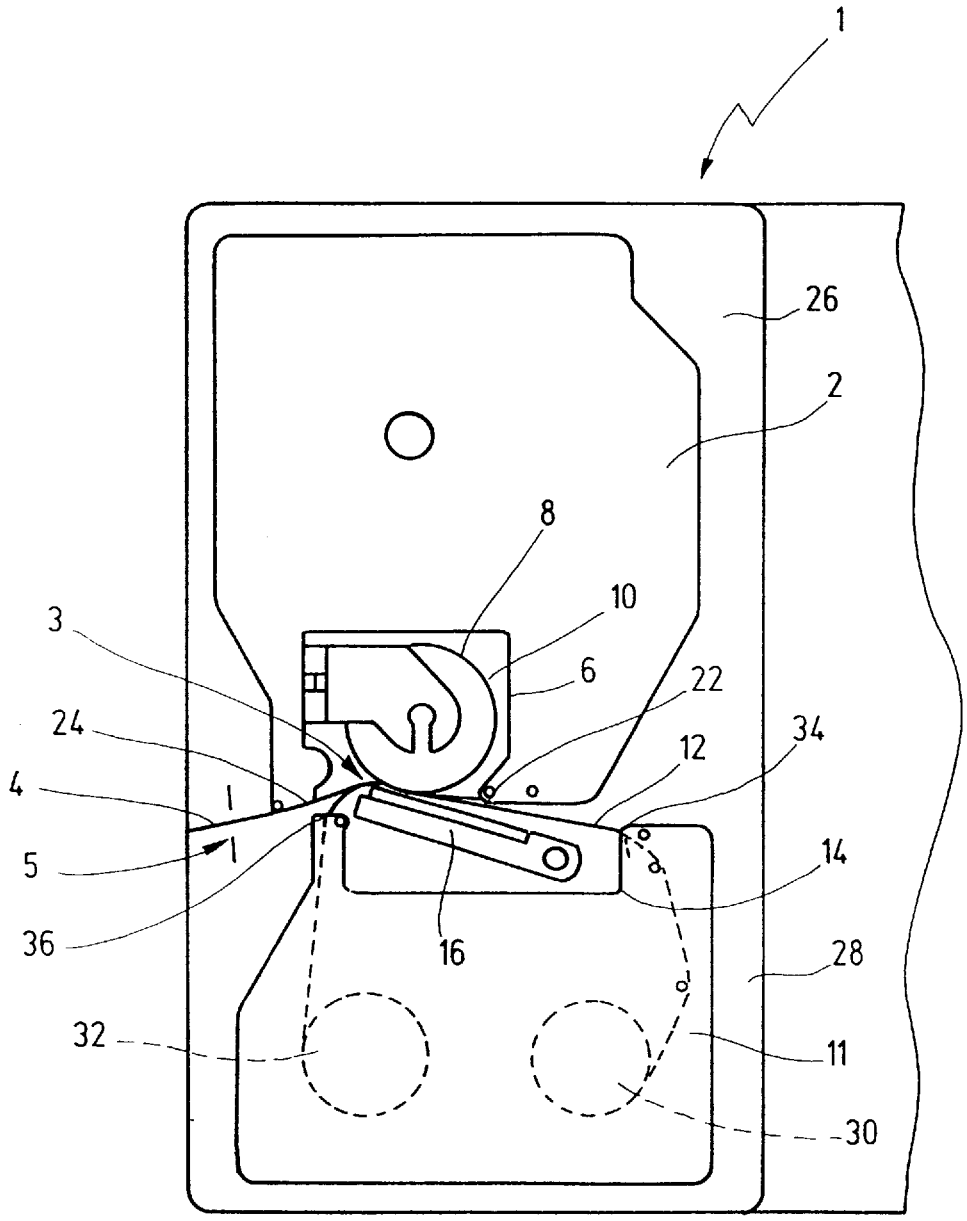
FIG. 1 is a planar view of a first tape printing device embodying the present invention using a two cassette system.

FIG. 1 shows a first tape printing device 1 embodying the present invention which has two cassettes arranged therein. Typically this tape printing device 1 is a battery-powered, hand-held or small desk top device. The upper cassette 2 is located in a first cassette receiving portion 26 and contains a supply of image receiving tape 4 which passes through a print zone 3 of the tape printing device 1 to an outlet 5 of the tape printing device 1. The image receiving tape 4 has an upper layer for receiving a printed image on one of its surfaces with the other surface coated with an adhesive layer. A releasable backing layer is secured to the adhesive layer. The upper cassette 2 has a recess 6 for accommodating a platen 8 of the tape printing device 1, and guide portions 22, 24 for guiding the tape 4 through the print zone 3. The platen 8 is mounted for rotation within a cage molding 10. Alternatively, the platen 8 could be mounted for rotation on a pin.

The lower cassette 11 is located in a second cassette receiving portion 28 and contains a thermal transfer ribbon 12 which extends from a supply spool 30 to a take up spool 32 within the cassette 11. The thermal transfer ribbon 12 extends through the print zone 3 in overlap with the image receiving tape 4. The cassette 11 has a recess 14 for receiving a print head 16 of the tape printing device 1 and 12 through the print zone 3. The print head 16 is movable between an operative position, shown in FIG. 1, in which it is in contact with the platen 8 and holds the thermal transfer ribbon 12 and the image receiving tape 4 in overlap between the print head 16 and the platen 8 and an inoperative position in which it is moved away from the platen 8 to release the thermal transfer ribbon 12 and image receiving tape 4. In the operative position, the platen 8 is rotated to cause the image receiving tape 12 to be driven past the print head 16. The print head 16 is controlled to print an image on to the image receiving tape 4 by thermal transfer of ink form the ribbon 12. The print head 16 which will be described in more detail later, generally comprises a thermal print head having an array of printing elements which can be thermally activated in accordance with the desired image to be printed.

The tape printing device 1 has a lid which is hinged along the rear of the cassette receiving portions 26 and 28 and which covers both cassettes when they are in place.

A DC motor 7 (see FIG. 3) continuously drives the platen 8. The platen 8 is arranged to drive the image receiving tape 4 continuously through the print zone 3 by its own rotation. Reference is hereby made to European Patent Application No. 94308084.6 which describes the control of the DC motor and the contents of which are expressly incorporated herein by reference thereto.

The image 16 is printed by the print head 16 on the image receiving tape on a column by column basis. The columns are adjacent to one another in the direction of the movement of the tape 4. The DC motor 7 is provided with a shaft encoder to monitor the speed of rotation of the motor. Sequential printing of the columns of pixels by the print head 16 is controlled by the monitored speed of rotation of the motor 7. The control of the speed of the motor 7 is achieved by the microprocessor chip 100 as discussed in relation to FIG. 3. The shaft encoder generates pulses which are frequency dependent on the speed of the motor 7 and the pulses cause the microprocessor chip 100 to generate data strobe signals. These signals cause a column of pixel data to be printed by the print head 16.

Figure 2:
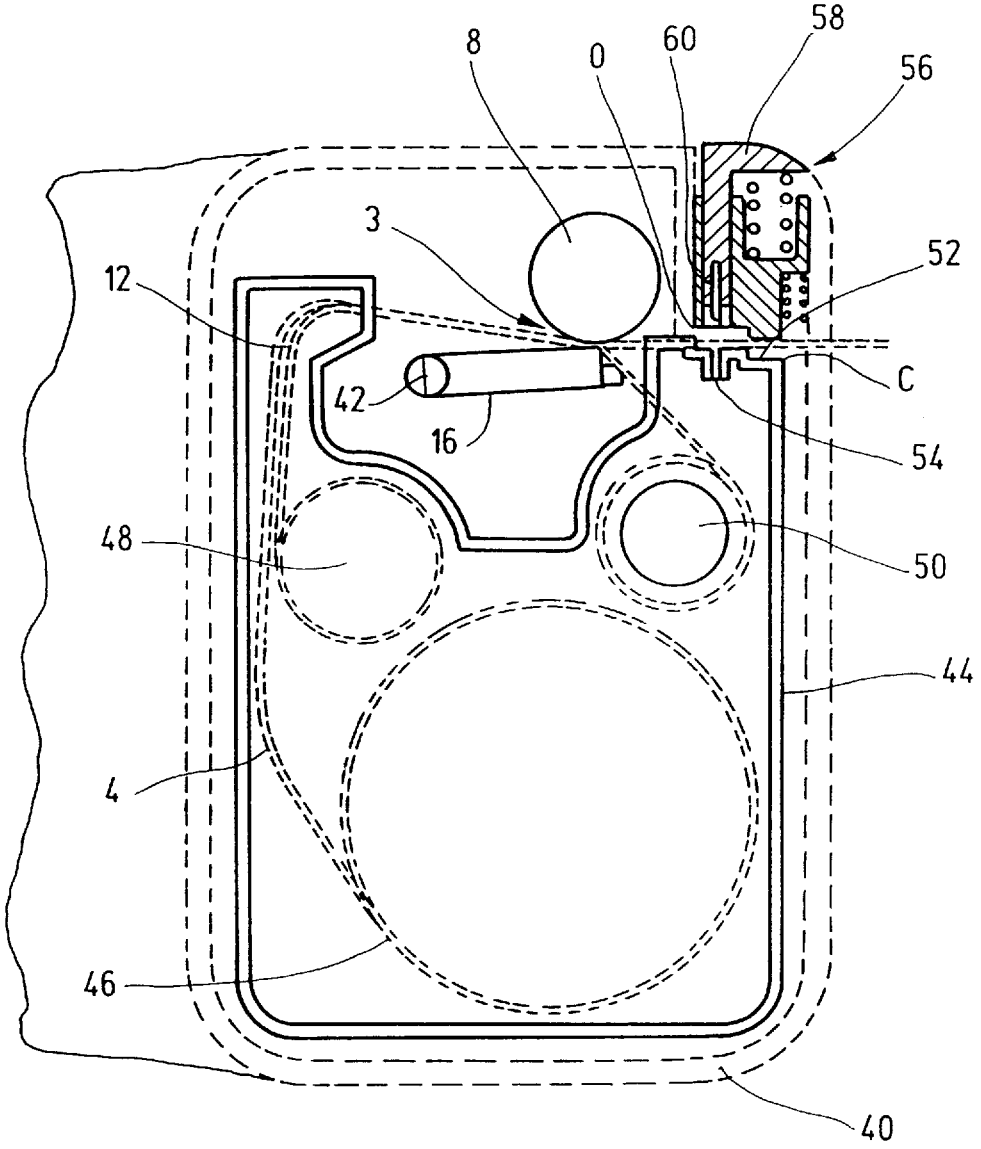
FIG. 2 is a planar view of a second tape printing device embodying the present invention, using a one cassette system.

FIG. 2 illustrates the cassette bay of a second printing device 1' embodying the present invention which uses a one cassette system. Like reference numerals will be used for those parts which are also shown in FIG. 1. The cassette bay is shown by the dotted line 40. The cassette bay 40 includes a thermal print head 16 and a platen 8 which cooperate to define a print zone 3. The print head 16 is movable about a pivot point 42 so that it can be brought into contact with the platen 8 for printing and moved away from the platen 8 to enable a cassette to be removed and replaced, as in the first embodiment. A cassette inserted into the cassette bay 40 is denoted generally by reference numeral 44. The cassette 44 holds a supply spool 46 of the image receiving tape 4. The image receiving tape 4 is guided by a guide mechanism (not shown) through the cassette 44, through an outlet 0, and past the print zone 3 to a cutting location C. The same cassette 44 also has an ink ribbon supply spool 48 and an ink ribbon take up spool 50. The ink ribbon 12 is guided from the ink ribbon supply spool 48 through the print zone 3 and accumulated on the ink ribbon take up spool 50. As with the first embodiment, the image receiving tape 4 passes in overlap with the ink ribbon 12 through the print zone 3 with its image receiving layer in contact with the ink ribbon 12.

The platen 8 of this second embodiment is also driven by a DC motor 7 (see FIG. 3) so that it rotates to drive continuously the image receiving tape 4 through the print zone 3 during printing. In this way, an image is printed on the tape and fed out from the print zone 3 to the cutting location C which is provided at a location on a portion of the wall of the cassette 44 which is close to the print zone 3. The portion of the wall of the cassette 44 where the cutting location C is defined is denoted by reference 52. A slot 54 is defined in the wall portion 52 and the image receiving tape 4 is fed past the print zone 3 to the cutting location C where it is supported by facing wall portions on either side of the slot 54.

The second tape printing device 1' includes a cutting mechanism 56 having a cutter support member 58 which carries a blade 60. The blade 60 cuts the image receiving tape 4 and then enters the slot 54.

Figure 3:
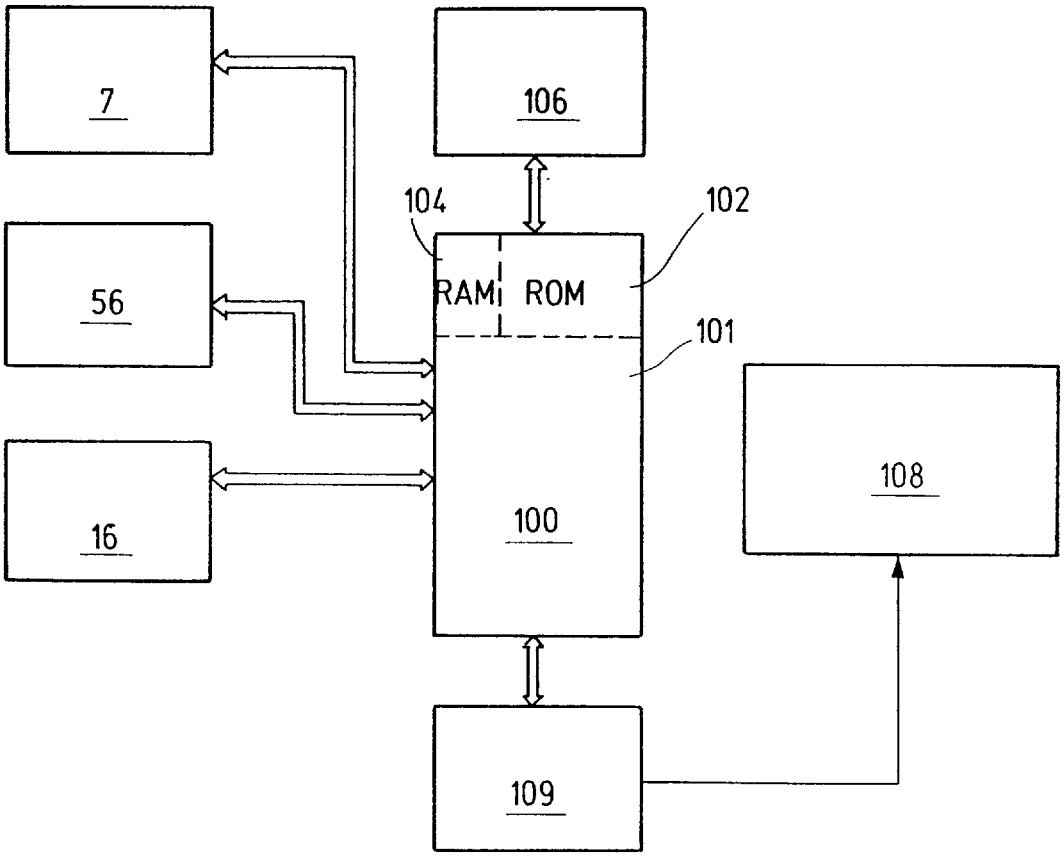
FIG. 3 is a diagram showing the control circuitry for the printing device of FIG. 1 or of FIG. 2.

The basic circuitry for controlling the tape printing device 1 of FIG. 1 or the tape printing device 1' of FIG. 2 is shown in FIG. 3. There is a microprocessor chip 100 having a read only memory (ROM) 102, a microprocessor 101, and a random access memory (RAM) 104. The microprocessor chip 100 is connected to receive label data from a data input device such as a keyboard 106. The microprocessor chip 100 outputs data to a display 108 via a display driver chip 109 to display a label to be printed, a portion of a label to be printed, and a message for the user. Alternatively, the display driver may form part of the microprocessor chip. Additionally, the microprocessor chip 100 also outputs data to the print head 16 so that the label data is printed on the image receiving tape 4 to form a label. Finally, the microprocessor chip 100 also controls the DC motor 7 for driving the platen 8. The microprocessor chip 100 may also control the cutting mechanism 56 of FIG. 2 or a cutting mechanism of FIG. 1 to allow pieces of tape to be cut off.

The print head 16 shown in FIGS. 1 and 2 will now be described in more detail with reference to FIGS. 4 and 5. The type of print head 16 associated with embodiments of the present invention generally comprise a plurality of printing elements 120 which are selectively heated for thermal printing. This thermal printing can be done directly on the thermally sensitive image receiving tape 4 or can be done through an ink ribbon 12 such as shown in the embodiments of FIGS. 1 and 2. As discussed in relation to these embodiments, the ink ribbon 12 is arranged between the print head 16 and the image receiving tape 4. The application of heat to the ink ribbon 12 by selected printing elements 120 of the print head 16 causes an image to be transferred to the image receiving tape 4.

Figure 4A:
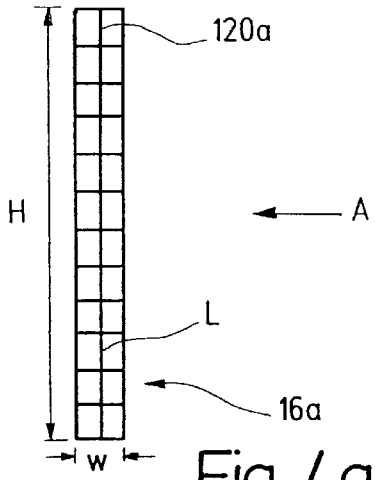
Fig. 4a Prior Art
FIG. 4*a* shows a schematic view of a prior art print head.

Before describing various print heads 16 embodying the present invention, the general construction of known print head **16*a* will be described with reference to FIGS. 4*a* and 5*a*. The known print head 16*a* comprises a plurality of printing elements 120*a*. In the schematic representation shown, there are twelve printing elements. However, print heads generally have many more printing elements (e.g., 128). The print head 16*a* generally has a height H slightly less than the width of the image receiving tape 4 to be used with the tape printing device 2. Where more than one width of tape is to be used with the tape printing device 2, the print head 16*a* will generally have a height H corresponding to the width of the largest image receiving tape 4 to be used with the tape printing device 12. Generally, the width W of the print head 16*a* is made equal to the width of one printing element 120***a* to form a column-shaped print head 16*a*. Each printing element 120*a* is generally square to print a generally square pixel on the image receiving tape.

Each printing element 120*a* is a resistive element. When current is passed through the element, it becomes heated. The printing elements 120*a* are selectively heated to allow an image to be printed on the image receiving tape 4 as it passes the print head 16*a*. The image printed on the image receiving tape 4 is defined by a plurality of contiguous or adjacent columns of pixels. Thus, the image printed on the image receiving tape 4 depends on which printing elements 120*a* are activated or heated over time. The image receiving tape 4 moves generally in the direction of arrow A, which is in the lengthwise direction of the image receiving tape 4 and perpendicular to the longitudinal axis L of the print head 16*a*.

Figure 5A:
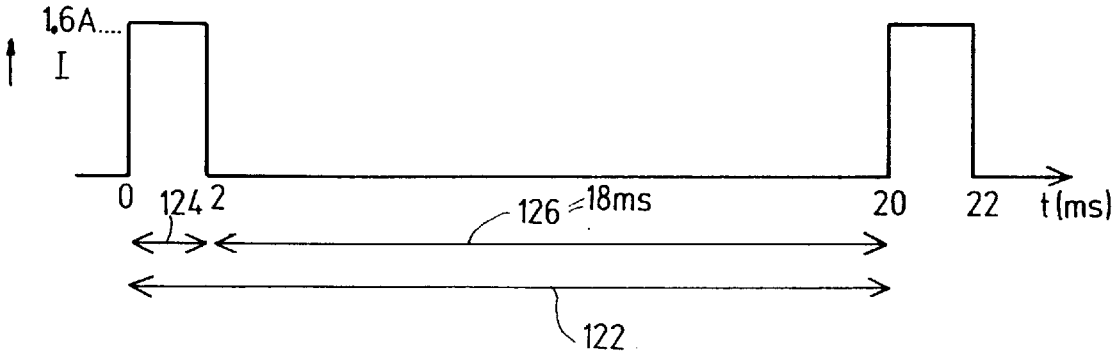
Fig. 5a Prior Art
FIG. 5*a* shows the relationship between current and time for the print head of FIG. 4*a;*

Reference will now be made to FIG. 5*a* which shows the relationship between current and time for the print head 16*a* shown in FIG. 4*a*. As can be seen, the print head 16*a* has a cycle 122 which comprises two parts. In the first part 124 of the cycle, current is applied to those printing elements 120*a* which are to be activated in that given cycle. It is possible that all elements of the print head 16*a* can be activated at the same time in the first part 124 of the cycle. For a 12 volt supply, the peak current will be 1.6 amps. Typically, the duration of the first part 124 of the cycle 122 is 2 milliseconds. The second part 126 of the cycle 122 is typically of 18 milliseconds duration giving a total cycle time of 20 milliseconds. The second part 126 of the cycle allows the power source to rest between applications of current to the printing elements 120*a*. The average current over the cycle is about 0.16 amps. The peak current is very much larger than the average current.

Figure 4B:
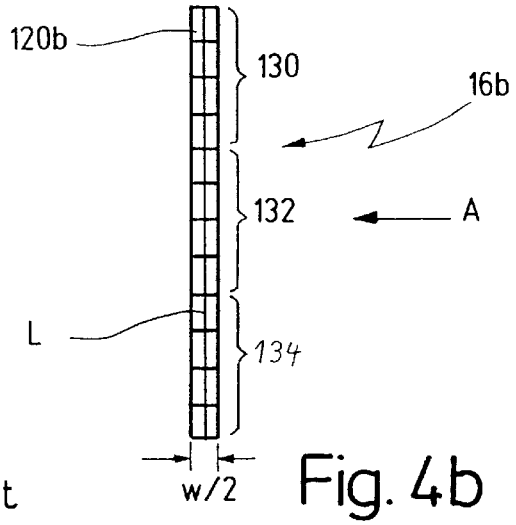
FIG. 4*b* shows a schematic view of a first print head embodying the present invention.

A first print head 16*b* embodying the present invention will be described with reference to FIG. 4*b* and FIG. 5*b*. The print head 16*b* shown in FIG. 4*b* is similar to that shown in FIG. 4*a*. However, one difference relates to the shape and size of the printing elements 120*b*. In particular, instead of being generally square to provide elements 120*a* of the known print head 16*a*, the printing elements 120*b* are generally rectangular. In particular, the same printing elements 120*b* when activated twice in succession, form a square pixel on the image receiving tape 4. In other words, each printing element 120*b* defines half a pixel in the printed image and has the form of a half of a square. Since printing elements 120*b* are resistive elements, the current required to heat the printing elements 120*b* shown in FIG. 4*b* to a desired temperature is proportional to the area of the printing element 120*b*. Accordingly, by halving the area of the printing element 120*b*, the current required to heat each printing element 120*b* for the same voltage is halved. If desired, all printing elements of the print head 16*b* can be activated at the same time.

Figure 5B:
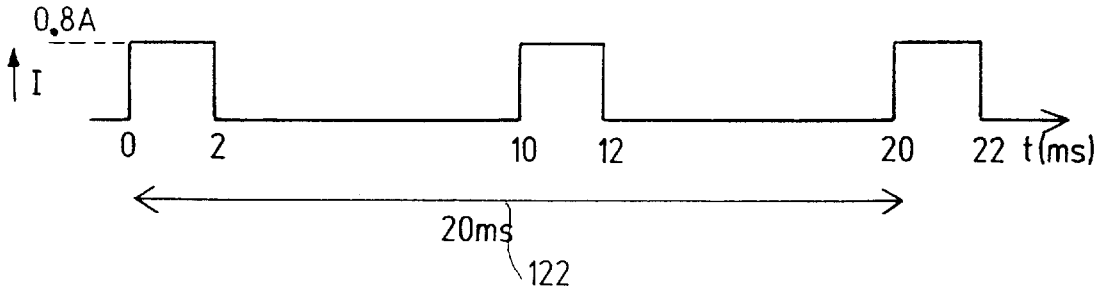
FIG. 5*b* shows the relationship between current and time for the print head of FIG. 4*b* when operated in a first way.

Reference is made to FIG. 5*b* which shows the relationship between current and time for print head 16*b*. For a given cycle of 20 milliseconds, current would be applied to the printing elements 120*b* of the print head twice to print one column of pixels on the image receiving tape 4. Each application of current would last approximately 2 milliseconds and would have a peak current value of 0.8 A which results in an average current of 0.16 A. Thus as compared to the embodiment shown in FIG. 4*a*, the peak current is halved but the average current remains unchanged. The printing elements 120*b* can also be one third or even one quarter of a square. These printing elements define a square pixel in the printed image when the same printing elements 120*b* are activated in succession three or four times respectively.

As discussed above, the image receiving tape 4 moves in the direction of arrow A past the print head. To improve the appearance of the image printed on the image receiving tape 4, the speed of the image receiving tape 4 may, as compared to the prior art, be decreased. This decrease would reduce the average current over a printing cycle since the length of the printing cycle is effectively increased. The image receiving tape 4 moves at a speed of between 4 and 10 and typically 7 millimeters per second past the print head 16*b*. However, it would be possible for the image receiving tape 4 to move more quickly or more slowly past the print head 16*b*.

Figure 5C:
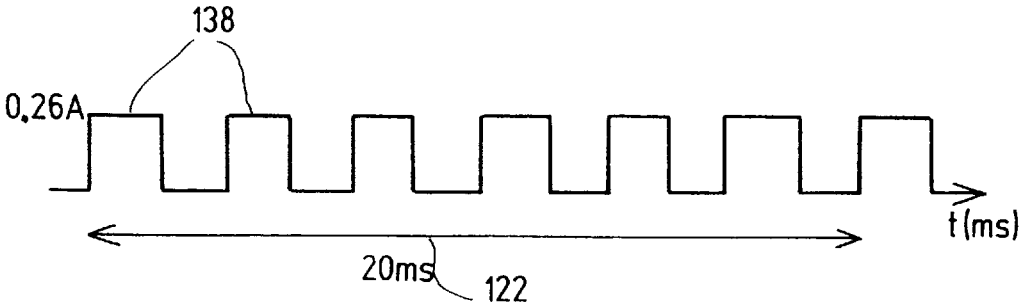
FIG. 5*c* shows the relationship between current and time for the print head of FIG. 4*b* when operated in a second way.

The embodiment shown in FIG. 4*b* can be modified to divide the print head 16*b* into three sections 130, 132, and 134. If desired, as many as eight sections can be provided. For illustrative purposes, each section 130, 132, and 134 has four printing elements 120*b*. In one preferred embodiment, each section 130, 132, and 134 may have thirteen printing elements, although any number between 2 and 32 printing elements, inclusive, can be used as desired. The three sections 130, 132, and 134 are arranged to be activated or strobed consecutively. In other words, in a given cycle the selected printing elements 120*b* of the first section 130 are activated first. Subsequently, the selected printing elements 120*b* of section 132 are activated and finally, the selected printing elements 120*b* of the third section 134 are activated. Thus, at any one time, only a fraction of the printing elements are activated, with a maximum of one third of all the printing elements 120*b* of the print head 16*b* being activated for the embodiment shown in the figure. The relationship between current and time for this modified embodiment of FIG. 4*b* is shown in FIG. 5*c*. As can be seen from FIG. 5*c*, the three sections 130, 132 and 134 of the print head 16*b* are strobed or activated at equally spaced intervals across the cycle 122. In particular, there are six periods 138 in which current is applied to respectively to sections 130, 132, and 134 of printing elements 120*b*. The peak current for the printing elements 120*b* would be one sixth of the peak current shown in FIG. 5*a* because the printing elements 120*b* which are activated at any given time are half the size of those of FIG. 4*a*. The average current will be the same as the average current for FIG. 4*b* since the print head 16*b* is activated twice in its entirety in each printing cycle. Where the printing elements are "full sized" and need to be activated only once to provide a pixel on the tape, each group of printing elements may only be activated once in a printing cycle.

The printing elements 120*b* need not be rectangular in the modified print head 16*b* shown in FIG. 4*b* and discussed in relation to FIG. 5*c* but they can be generally square as in the prior art.

Figure 4C:
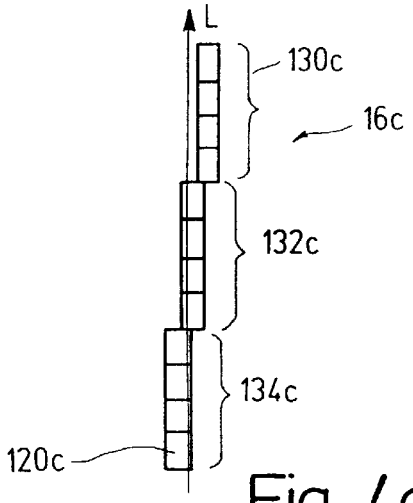
FIG. 4*c* shows a schematic view of a second print head embodying the present invention.
Figure 4D:
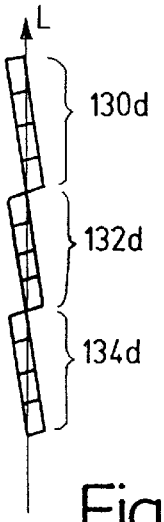
FIG. 4*d* shows a schematic view of a third print head embodying the present invention.
Figure 4E:
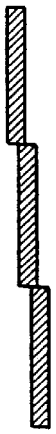
FIG. 4*e* shows an image printed with the print head of FIG. 4*b;*

As the image receiving tape 4 continually moves past the print head 16 in the direction of arrow A, use of a print head 16*b* such as shown in FIG. 4*b*, with the three sections 130, 132 and 134 energized or strobed in sequence, will provide an image on the image receiving tape 4 which is staggered, such as shown in FIG. 4*e*. For some embodiments, this stagger may not have a significant impact on the quality of printing. However, for those embodiments where it is desired to improve the quality of printing, the print head shown in FIG. 4*c* may be used. The print head 16*c* has three sections 130*c*, 132*c*, and 134*c* which are staggered with respect to each other in a direction opposite to that of the image which would be produced by the print head 16*b* as shown in FIG. 4*e*. Each section 130*c*, 132*c*, 134*c* is made up of four printing elements 120*c* similar to those shown in FIG. 4*b*. As with the print head 16*b* shown in FIG. 4*b*, the printing elements 120*c* in section 130*c* are activated first followed by the printing elements 120*c* in section 134*c*. As the image receiving tape 4 moves in the direction of arrow A, the stagger in the image printed with the print head 16*b* of FIG. 4*b* can be corrected. In particular, the print head 16*c* is designed to take into account the speed of the tape 4. Thus, when the second section 132*c* is ready to print, it prints an image directly underneath and aligned with the image printed by section 130*c* of the print head 16*c*. Likewise, the third section 134*c* is arranged to print an image directly below and in line with that printed by the first and second sections 130*c* and 132*c*. In certain embodiments, the stagger between two adjacent sections 130*c*, 132*c* and 134*c* may be equal to one third the pitch between adjacent printing positions. This stagger may be slightly less than one third of the width of each printing element. The printing elements 120*c* may be the same as those shown in respect of FIG. 4*a* or 4*b*.

Figure 4F:
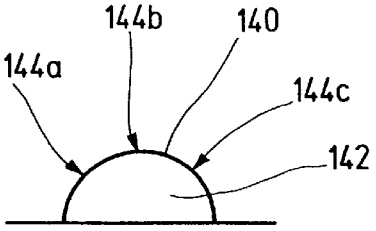
FIG. 4*f* shows a cross-sectional view through the print head of FIG. 4*c;*

When the print head 16*c* is viewed in cross-section as shown in FIG. 4*f*, the printing elements 120*c* of the print head 16 actually lie on the top 140 of a "glaze bump" 142. A print head is generally made up of a ceramic substrate where resistive elements are deposited. These resistive elements are the printing elements of the print head. However, in order to improve the contact between the printing medium and the printing elements, the resistive elements are deposited on top of a glaze. This glaze has a generally semicircular profile and extends generally in the direction of the longitudinal axis L of the print head 16 to define a "glaze bump". With a staggered print head 16*c* such as shown in FIG. 4*c*, the center of the printing elements 120*c* of sections 130*c*, 132*c*, and 134*c* will be at different locations on the glaze bump 142. For example, the center of the printing elements could be at location 144*a*, 144*b*, and 144*c* respectively. Accordingly, the printing elements of sections 130*c*, 132*c*, and 134*c* will have a different relationship with the platen 8 which the print head 16*c* acts against. This situation may affect the quality of printing although with some embodiments of the invention, this problem may be negligible. In some embodiments of the invention, the radius of the glaze bump 142 may be increased to improve the quality of the print.

The print head 16*d* shown in FIG. 4*d* is intended to address this problem. In this embodiment each section of 130*d*, 132*d*, and 134*d* is angled at between 0.1–1° and preferably around 0.38°, with respect to the longitudinal axis L of the print head 16*d*. However, all the centers 133*a*, 133*b*, and 133*c* of sections 130*d*, 132*d*, and 134*d* respectively, lie along the longitudinal axis L of the print head 16*d*. Although, a complete compensation for the stagger is not achieved with the print head 16*d*, the appearance of stagger to the eye in the printed image is reduced as compared with the print head 16*b* of FIG. 4*b*. Additionally, it is also possible with the print head 16*d* to avoid a potential reduction in print quality which may be apparent with the print head 16*c* of FIG. 4*c*. However, there are embodiments of the present invention where the print heads 16*b*, 16*c* and 16*d* shown in FIGS. 4*b*, 4*c* and 4*d* have particular advantages.

The relationship between the current and time for the print heads shown in FIGS. 4*c* and 4*d* is the same as that shown in FIG. 5*c*.

For the purposes of comparison, it has been assumed in the above discussion that all of the print heads 16*a*, 16*b*, 16*c* and 16*d* shown in FIG. 4 have the same supply voltage and cycle time. However, Table 1 shows actual values of various parameters for embodiments of the present invention and the prior art.

| Print Head | Supply Voltage | Peak Current/ Duration | Average I | Cycle Length |
|---|---|---|---|---|
| 16a (Prior Art - FIG. 4a) | 12 V | 1.6 A/2 ms | 0.32 A | 10 ms |
| 16b (½ rectangles FIG. 4b) | 12 V | .8/2 ms | 0.32 A | 10 ms |
| 16b/16c/16d (3 sections + ½ rectangles FIGS. 4b, 4c, 4d) | 5 V | 0.67 A/2 ms | 0.38 A | 21 ms |

As shown in Table 1, embodiments of the present invention are able to activate the print heads 16*b*, 16*c*, and 16*d* with smaller peak currents than the prior art embodiment. Alternatively, if the peak current remains comparable with the prior art arrangements, the voltage requirements can be reduced. Thus, the embodiments of FIGS. 4*b* to 4*d* are able to reduce the peak current to average current ratio as compared to the prior art as shown in FIG. 4*a* to give a smoother averaged current across the printing cycle. In other words, the peak current is closer to the average current and preferably less than three times larger.

Figure 6:
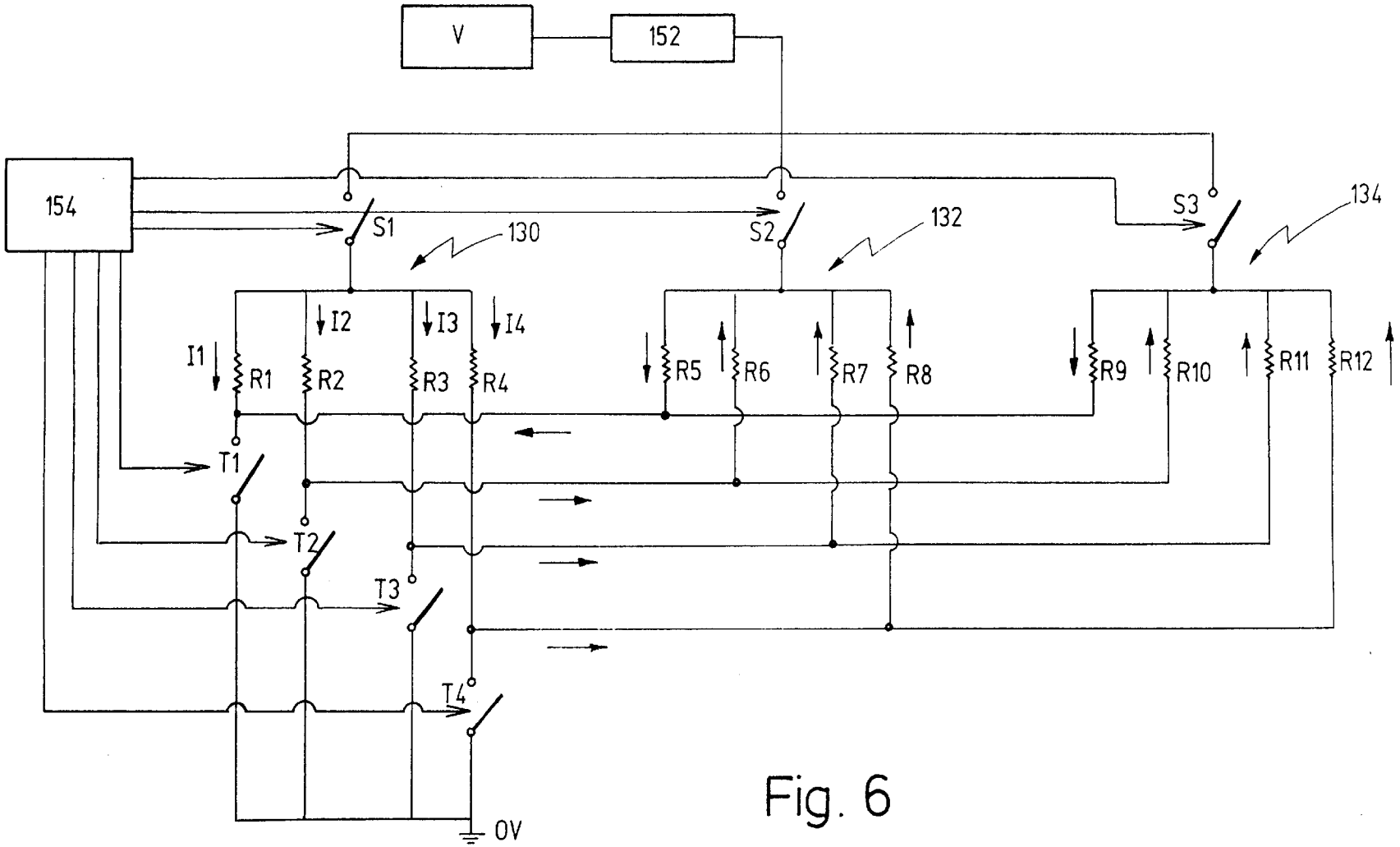
FIG. 6 shows a circuit diagram for the control of the print head shown in FIGS. 4*b,* 4*c* or 4*d.

Reference will now be made to FIG. 6 which illustrates the control of the printing elements 120 of print head 16 shown in FIGS. 4*b*, 4*c* or 4*d*.

As discussed above, each printing element 120*b* generally comprises a resistive element. Accordingly, the printing elements 120 are represented in FIG. 6 by resistors R1–R12. The printing elements 120 or resistors R1–R12 are grouped in three groups of four. These three groups represent sections 130, 132 and 134 respectively of the print head 16*b*, 16*c* and 16*d*. Each section 130, 132 and 134 is connected to the print head voltage supply V via respective switches S1, S2, and S3 which define group select switches. This, a switch S1, S2 and S3 is provided for each section 130, 132 and 134 of the print head 16. These switches can take any suitable form and are preferably either bipolar transistors or FETs.

The first resistors R1, R5, or R9 of each section 130, 132 and 134 are connected together. Likewise, the second resistors R2, R6, and R10 are connected together as are the third resistors R3, R7, and R11 of each section 130, 132, and 134. Finally, the fourth resistors R4, R8, and R12 of each section 130, 132, and 134 are all connected together.

The first resistors R1, R5, and R9 of each section 130, 132 and 134 are connected to switch T1. The second resistors R2, R6, R10 of each section 130, 132, and 134 are connected to switch T2. The third resistors R3, R7, and R11 are connected to switch T3. Finally, the fourth resistors R4, R8, and R12 of each section 130, 132, and 134 are connected to switch T4. As with switches S1 to S3, switches T1 to T4 are preferably bipolar transistors or FETs. However, any other suitable switching device can be used. Switches T1 to T4 define a common set of switches which are arranged to control the selective activation of printing elements 120 in each group 130, 132 and 134.

The switches T1 to T4 are in parallel with one another as are resistors R1 to R12. The switches T1 to T4 are connected to ground. The switches T1 to T4 and S1, S2 and S3 are controlled by a controller 154 which may be the microprocessor 100. Alternatively, a separate controller can be provided which may form part of the print head 16. Means may be provided for converting the serial output of the microprocessor into a parallel output. Alternatively, a parallel output may be provided by the microprocessor 100. The arrangement shown in FIG. 6 allows a multiplexed driving of the print head 16 which can simplify the control of the printing elements 120. Particular embodiments of the invention can dispense with a print head controller which is present on the print heads of the prior art to reduce the cost of the print head 16. The control can be simply achieved as discussed above using the microprocessor.

The print head voltage supply V comprises a battery source which typically comprises six 1.5 volt batteries giving a total supply of nine volts. The voltage supply V is connected to a low voltage linear regulator 152 which provides a constant voltage of around five volts. The low voltage linear regulator 152 decreases the voltage to the required five volt level. A nine volt supply is required to ensure that there is always a five volt supply as the linear regulator 152 requires a certain "drop out" voltage to operate. Additionally, the battery voltage level will decrease during the printing operation.

The operation of the circuit shown in FIG. 6 will now be described. The switches S1, S2 and S3 are energized or strobed. in other words, the switches are turned on by successive strobe pulses provided by the controller 154. In this way, the print head sections 130, 132, and 134 are energized sequentially as only one of these switches 130, 132, and 134 of the print head will be energized at a given time. The switches T1 to T4 are selectively closed (i.e. turned on) depending on which of the printing elements 120 of the energized section 130, 132, and 134 are to be activated. Thus, all of the switches T1 to T4, some of the switches T1 to T4, or none of the switches T1 to T3 may be on. In other words, the switches T1 to T4 determine which printing elements 120 are activated in each section 130, 132, and 134 of the print head. For example, if section 130 is energized when switch S1 is closed and printing element R1 needs to be activated, then switch T1 needs to be closed. If, on the other hand, printing element R1 is not to be activated, then switch T1 will remain open (i.e. off). In this way, the individual printing elements 120 can be controlled by means of switches T1 to T4.

The total number of switches required equals N/M+M where N equals the number of printing elements 120 and M equals the number of sections 130, 132, and 134 of the print head 16. This number of switches is smaller than the number required by the prior art, which requires a switch for each individual printing element.

When switch S1 is on, S2 is off, S3 are off, T1 is on, and switches T2, T3 and T4 are off, the arrows in FIG. 6 show the direction of the various currents in the circuit. Current I1 is the activation current which activates printing element R1. I2, I3, and I4 are parasitic currents. These parasitic currents may cause printing elements 120 which should not be activated to be activated. These printing elements may be in a section 132 and 134 which is inactive or in a section 130 which is active.

In one embodiment of the present invention, a diode is placed in series with each of the resistive elements R1 to R12. These diodes are able to prevent parasitic currents from appearing in the circuit. However, although the solution is used in certain embodiments of the invention, diodes increase the number of required components which is disadvantageous. Additionally, the number of diodes which would be required would undesirably increase the cost of the apparatus.

It has been ascertained that a printing element 20 will not print if the energy level applied to a printing element (i.e. a current) is below a given level. Experimentally, it has been determined that in some embodiments of the invention printing will not occur if the energy level applied to the printing element 120 is less than 40% of the normal printing energy level required. Thus, if the circuit shown in FIG. 6 limits the parasitic currents such as I2, I3, and I4 to an associated energy level which is below 40% of the normal printing energy, then the unintended activation of printing elements 120 can be avoided. In those embodiments, the presence of diodes would not be necessary. Factors which affect the current levels in inactivated printing elements may include one or more of the following: the number of printing elements, the number of groups of printing elements, and/or the characteristics (such as resistance) of the printing elements.

This latter arrangement has been found to be particularly advantageous where M is approximately 3 and N does not greatly exceed around 24. Such embodiments of the present invention, which have the print head divided into three sections have been found to be advantageous as wasted energy is minimized, parasitic currents do not exceed the 40% energy level, and the peak current is reduced.

Figure 7:
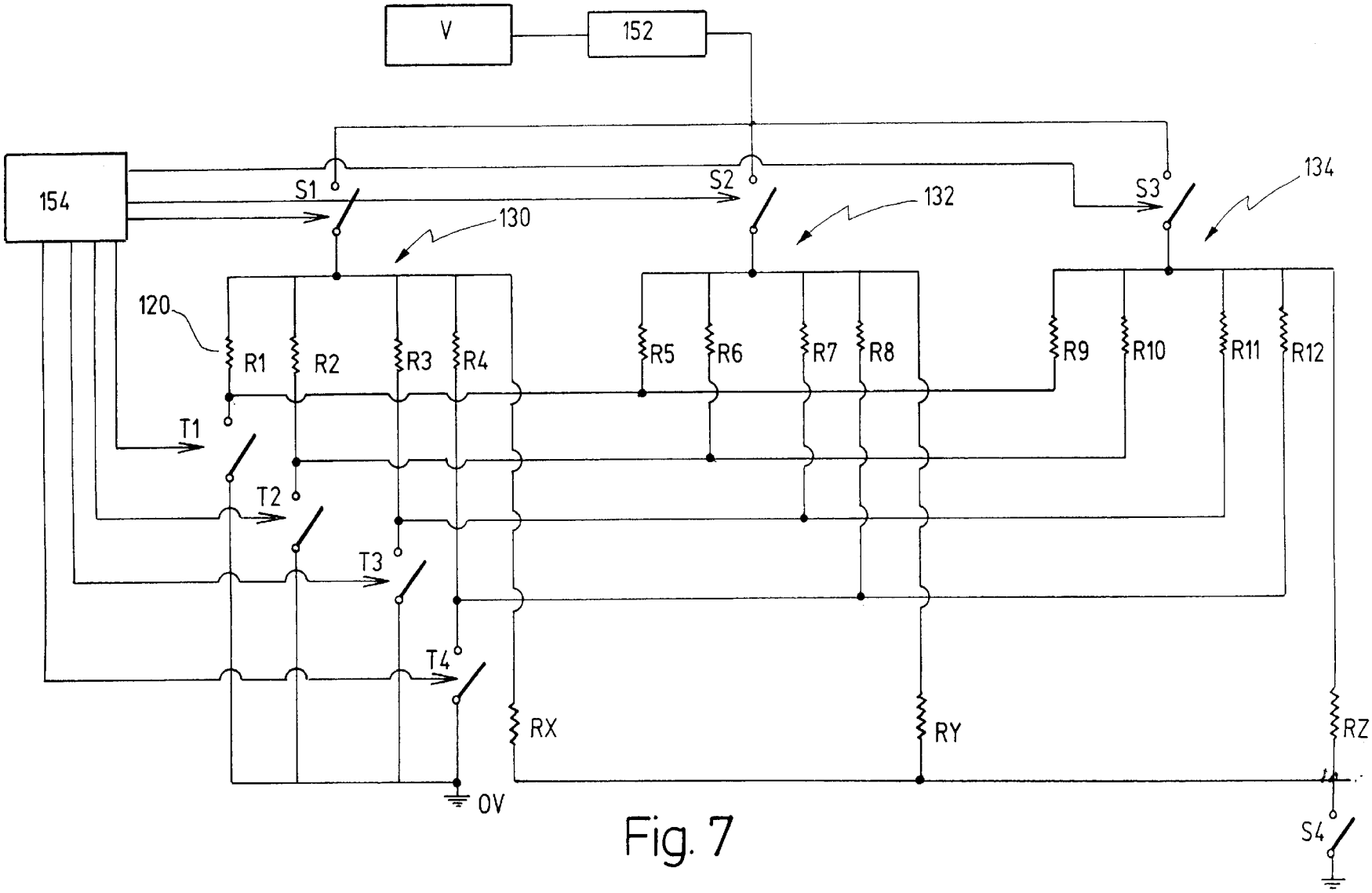
* and FIG. 7 shows a modified version of the circuit diagram shown in FIG. 6 for the control of the print head shown in FIGS. 4*b,* 4*c* or 4*d.*

Reference will now be made to FIG. 7 which shows a modification to the circuit shown in FIG. 6. The circuit shown in FIG. 7 is the same as that shown in FIG. 6 with the addition of three further resistors RX, RY, and RZ. RX is connected to switch S1 and is arranged in parallel with resistors R1 to R4. RY is connected to switch S2 and is connected in parallel with resistors R5 to R8. Finally, RZ is connected to switch S3 and is arranged in parallel with resistors R9 to R12. The resistors RX, RY, and RZ are connected in parallel and are connected to a further switch S4 which is connected to the ground. The switch S4 is also controlled by controller 154.

The embodiment shown in FIG. 7 is particularly advantageous where the parasitic currents may cause activation of printing elements 120, which would be inactivated by supplying an energy level greater than 40% of the normal printing energy. The levels of parasitic currents which could cause problems typically arise when only a few of the printing elements R1 to R12 are activated in a selected section 130, 132 and 134 of the print head 16. As discussed above, if the printing elements 120 are activated to an energy level which is greater than 40% of the normal printing energy, unwanted activation of a printing elements 120 can occur. Resistors RX, RY, and RZ are provided to steer current away from printing elements 120 that could print parasitically. In particular, when there is a risk of parasitic printing, as in the circumstance discussed above, switch S4 is turned on. Current then flows through RX, RY, and RZ and away from those printing elements that could parasitically print. The resistive values of RX, RY and RZ are generally lower than those of the printing elements R1 to R12. The optimum value of RX, RY and RZ can be ascertained experimentally by trial and error. With the resistors RX, RY, and RZ and with switch S4 turned on, any parasitic currents flowing through printing elements 120 should not be activated during a given cycle can be maintained below the 40% threshold value. In some embodiments, the switch S4 could be removed and the resistors RX, RY, and RZ would always provide an alternative path to reduce the risks of parasitic printing. However, this scheme may unnecessarily waste energy which is why preferred embodiments use switch S4 to limit the use of the resistive paths defined by RX, RY, and RZ to situations where there is an actual risk of parasitic printing.

The embodiment shown in FIG. 7 is particularly suited to those embodiments which typically have more than 24 printing elements 120. In this way, the need for diodes, as discussed above, can be avoided. However, diodes may also be used with such an arrangement, if desired.

There are several modifications possible to the embodiments described. For example, the DC motor could be replaced by a stepper motor. In those circumstances, movement of the tape could be in a step wise fashion. Thus, if a stepper motor is used, the staggered print head shown in FIGS. 4*c* and 4*d* is not necessary. However, the activation of separate sections of the print head at different times is advantageous in those embodiments which use a stepper motor.

In the embodiments shown, the print head is divided up into three sections which are successively activated. As noted above, however, the print head can of course be divided up into any other number of suitable sections. Additionally, the printing elements in each section need not be adjacent to each other. For example, alternate printing elements may be selectively activated and define the respective sections respectively. With these latter embodiments, the effects due to staggering may be less apparent for certain printed characters.

What is claimed is:

1. A tape printing device comprising:

a print head comprising a set of selectively activatable printing elements arranged generally along a longitudinal axis of said print head;

means for causing relative movement between an image receiving tape and said print head to print an image on said image receiving tape in the form of a plurality of contiguous columns of pixels; and control circuitry controlling said print head, said control circuitry generating a plurality of printing cycles for each of said plurality of contiguous columns of pixels to be printed, wherein each of selected pixels in each of said plurality of contiguous columns of pixels is printed by activation of a corresponding one of said printing elements by substantially uniform application of electrical energy thereto successively during each of said plurality of printing cycles at contiguous but non-overlapping locations on said image receiving tape in order to reduce peak current transmitted required by printing elements.

2. A tape printing device as claimed in claim 1, wherein said print head is a thermal print head.

3. A tape printing device as claimed in claim 1 wherein each of said pixels is printed by generating two or more successive printing cycles wherein in each of said successive printing cycles the same ones of said printing elements are activated twice at contiguous locations on said image receiving tape, wherein the activated printing elements are switched off between the printing cycles.

4. A tape printing device as claimed in claim 3, wherein activation of the same ones of said printing elements at contiguous locations on the image receiving tape by said successive printing cycles generates generally square pixels.

5. A tape printing device as claimed in claim 1, wherein each of said printing elements has a rectangular shape and each of said pixels of said plurality of contiguous columns of pixels has a square shape.

6. A tape printing device as claimed in claim 5, wherein the square shape of each pixel is formed from between 2 and 8 activations of the rectangular shaped printing elements.

7. A tape printing device as claimed in claim 1, wherein each printing element has a square shape.

8. A tape printing device comprising:

a print head comprising a set of selectively activatable printing elements arranged generally along a longitudinal axis of said print head;

means for causing relative movement between an image receiving tape and said print head to print an image on said image receiving tape in the form of a plurality of contiguous columns of pixels; and control circuitry controlling said print head, said control circuitry generating a plurality of printing cycles wherein in each of said plurality of printing cycles selected ones but less than all of said printing elements are activated by substantially uniform application of electrical energy thereto to print part of a line on said image receiving tape, wherein each pixel in one of said plurality of contiguous columns of pixels is printed by generating a plurality of successive printing cycles wherein in each of said plurality of successive printing cycles the same ones of said printing elements are activated a corresponding plurality of times at contiguous locations on said image receiving tape;

wherein the means for causing relative movement between said image receiving tape and said print head performs a continuous relative movement while the printing elements are activated.

9. A tape printing device as claimed in claim 8, wherein said printing elements are arranged in at least two groups which are individually selectively activable at different times in each of said plurality of printing cycles.

10. A tape printing device as claimed in claim 9, wherein the activation periods of said at least two groups occur at different times in each of said plurality of printing cycles and are evenly distributed throughout each of said plurality of printing cycles.

11. A tape printing device as claimed in claim 9, wherein said at least two groups of printing elements are arranged to be staggered with respect to each other, whereby when said print head is arranged to print an image on said image receiving tape, the staggering of said at least two groups being arranged to compensate for the activation period for each of said at least two groups occurring at different times in said printing cycle.

12. A tape printing device as claimed in claim 11, wherein each of said at least two groups are horizontally staggered generally along a longitudinal axis of said print head.

13. A tape printing device as claimed in claim 11, wherein each of said at least two groups lies at an acute angle with respect to said longitudinal axis of said print head.

14. A tape printing device having a print head comprising at least two groups of printing elements, said printing elements being selectively activable to provide an image on a printing medium, said at least two groups activated at different times during a printing cycle, and control means comprising a common set of switches arranged to control the selective activation of said printing elements in each of said at least two groups and group select means for selecting between said at least two groups so that only one of said at least two groups is activated at a given time, wherein each of said common set of switches is arranged to control one of said printing elements in each of said at least two groups, wherein a resistive path is provided for each of said at least two groups, each of said resistive paths being arranged in parallel with said printing elements of said at least two groups, said resistive path steering current away from each of said printing elements which are not to be activated to prevent accidental activation of each of said printing elements.

15. A tape printing device as claimed in claim 14, wherein activation of the groups of said printing elements is conducted to generate generally square pixels.

16. A tape printing device as claimed in claim 14, wherein each of said printing elements has a rectangular shape and each pixel generated by said groups of printing elements has a square shape.

17. A tape printing device as claimed in claim 16, wherein the square shape of each pixel is formed by the activation of between 2 and 8 groups of rectangular shaped printing elements.

18. A tape printing device as claimed in claim 14, wherein said at least two groups of printing elements are arranged to be staggered with respect to each other, whereby when said print head is a thermal print head arranged to print an image, and the staggering of said at least two groups compensates for the activation period for each of said at least two groups occurring at different times in said printing cycle.

19. A tape printing device as claimed in claim 18, wherein each of said at least two groups are horizontally staggered generally along a longitudinal axis of said print head.

20. A tape printing device as claimed in claim 18, wherein each of said at least two groups lies at an acute angle with respect to said longitudinal axis of said print head.

* * * * *

UNITED STATES PATENT AND TRADEMARK OFFICE
CERTIFICATE OF CORRECTION

PATENT NO. : 5,826,994

DATED : October 27, 1998

INVENTOR : Mathew Richard Palmer

It is certified that error appears in the above-identified patent and that said Letters Patent is hereby corrected as shown below:

Column 13, line 35 (claim 1, line 9): change "controlling" to --which controls--.

Column 13, lines 40-41 (claim 1, lines 15-16): delete "by substantially uniform application of electrical energy thereto".

Column 14, line 9 (claim 8, line 9): after "circuitry" insert --for--.

Column 14, lines 13-14 (claim 9, lines 13-14): delete "by substantially uniform application of electrical energy thereto".

Signed and Sealed this

Fourth Day of May, 1999

*Attest:*

Q. TODD DICKINSON

*Attesting Officer*

*Acting Commissioner of Patents and Trademarks*